United States Patent [19]

Paul

[11] Patent Number: 4,946,227

[45] Date of Patent: Aug. 7, 1990

[54] BUCKET WHEEL ASSEMBLY

[75] Inventor: Raj Paul, Calgary, Canada

[73] Assignee: Esso Resources Canada Limited, Calgary, Canada

[21] Appl. No.: 354,602

[22] Filed: May 22, 1989

[51] Int. Cl.[5] ..... F21C 25/60

[52] U.S. Cl. ..... 299/39; 37/78; 37/189; 299/17; 299/67

[58] Field of Search ..... 299/17, 39, 67, 81; 37/78, 91, 189, 190

[56] References Cited

U.S. PATENT DOCUMENTS

| | | | |
|---|---|---|---|
| 3,374,033 | 3/1968 | Arentzen | 299/81 |
| 3,554,602 | 1/1971 | Chaney | 37/189 X |
| 4,573,743 | 3/1986 | Grathoff | 299/67 X |
| 4,691,967 | 9/1987 | Schupphavs | 299/17 X |

FOREIGN PATENT DOCUMENTS

| | | | |
|---|---|---|---|
| 3027786 | 2/1982 | Fed. Rep. of Germany | 299/17 |
| 3049216 | 7/1982 | Fed. Rep. of Germany | 299/17 |

*Primary Examiner*—Thuy M. Bui
*Assistant Examiner*—David J. Bagnell
*Attorney, Agent, or Firm*—Arne I. Fors

[57] ABSTRACT

A bucket wheel assembly for excavating solid material from the ground which can be slurried with water has a series of buckets mounted on a framework rotatable about a substantially horizontal axis, the buckets, being secured to the framework at spaced positions around the periphery, and each bucket having a leading edge portion engagable with the ground as the framework rotates to cause material to be scooped from the ground into the bucket. Sets of nozzles are mounted around the framework, each set of nozzles being located between an adjacent pair of buckets and spaced in the direction of movement of the buckets from the leading edge portion of a following bucket. A rotary valve is connected to the nozzles and to a source of liquid under pressure. The rotary valve is operated by rotation of the framework to cause liquid under pressure to be selectively supplied from the source of liquid under pressure to each set of nozzles in turn when the set of nozzles and its following bucket are approaching the ground to cause liquid from the set of nozzles to impinge on the ground and form a slurry of the material which is subsequently scooped into a following bucket.

5 Claims, 6 Drawing Sheets

BUCKET WHEEL ASSEMBLY

Figure 1:
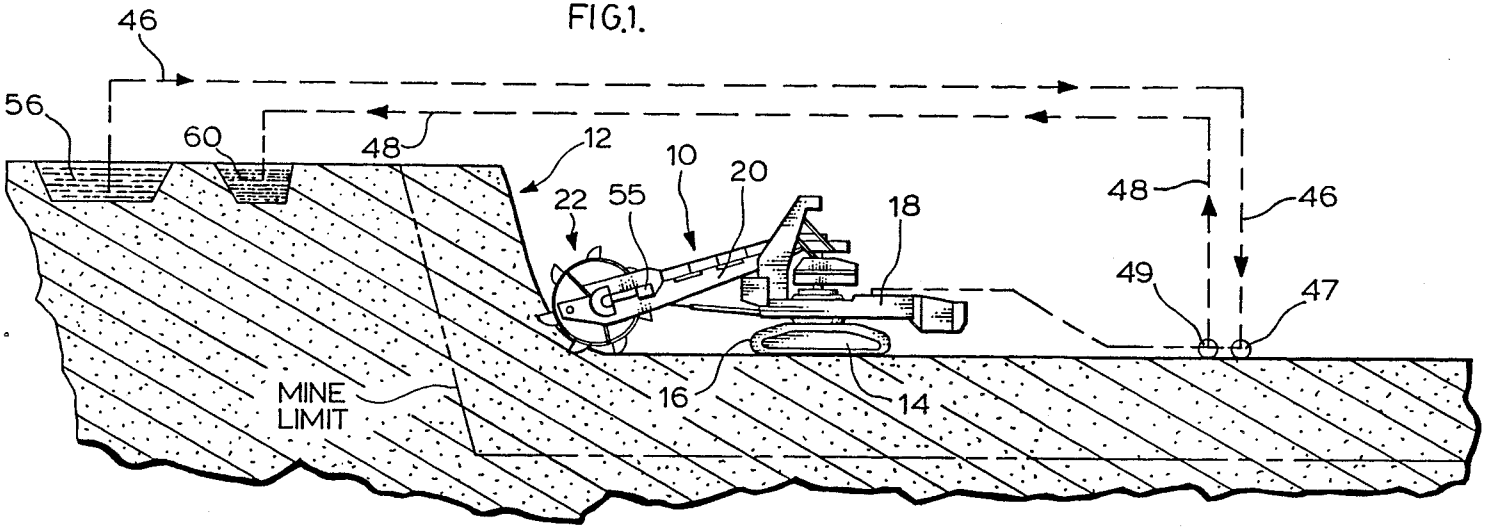

This invention relates to bucket wheel assemblies for excavating solid material from the ground.

It is well known to excavate solid material from the ground by means of a bucket wheel assembly which comprises a series of buckets mounted on a framework rotatable about a horizontal axis, the buckets being secured to the framework at spaced positions around the periphery thereof, and each bucket having a leading edge engagable with the ground as the framework rotates to cause material to be scooped from the ground into the bucket.

It is also known to facilitate such excavation by jetting high pressure liquid onto the ground to form slurry of the material which is subsequently scooped into the buckets. Proposals have been made to provide bucket wheel assemblies with nozzles to which liquid is supplied for this purpose. Proposals of this kind are described for example in U.S. Pat. No. 3,554,602 (Chaney), issued Jan. 12, 1971, in which the nozzles are carried by the boom on which the bucket wheel assembly is rotatably mounted, and in U.S. Pat. No. 4,573,743 (Grathoff), issued Mar. 4, 1986, in which oscillating nozzles are mounted on the buckets. However, for one reason or another, such prior proposals do not produce optimum results.

It is therefore an object of the present invention to provide a bucket wheel assembly with improved means for jetting liquid onto the ground to form a slurry of the material to be excavated.

According to the present invention, a series of nozzles means are mounted around the framework, with each nozzle means being located between an adjacent pair of bucket members and spaced in the direction of movement of the bucket members from the leading edge portion of a following bucket member, and rotary valve means are connected to the series of nozzle means, with the rotary valve means having means to enable a source of liquid under pressure to be connected thereto. The rotary valve means is operated by rotation of the framework, when a source of liquid under pressure is connected to the rotary valve means, to cause liquid under pressure to be selectively supplied from the source of liquid under pressure to each nozzle means in turn when the nozzle means and its following bucket member are approaching the ground to cause liquid from the nozzle means to impinge on the ground and form a slurry of the material which is subsequently scooped into a following bucket member.

It has been found that such positioning of the nozzle means provides a significantly improved slurrying effect compared to known proposals.

Each nozzle means may comprise a set of nozzles aligned in a substantially straight row which extends transversely of the bucket wheel assembly in a direction substantially parallel to the access rotation of the framework. Alternatively, each nozzle means may comprise a set of nozzles aligned in a substantially straight row extending transversely of the bucket wheel assembly in a direction inclined to the direction of movement of the bucket members.

Each nozzle means may comprise a first set of nozzles aligned in a substantially straight row adjacent to one side of the bucket wheel assembly, said first set of nozzles extending transversely of the bucket wheel assembly in a first direction inclined to the direction of movement of the bracket members, and a second set of nozzles aligned in a substantially straight row adjacent an opposite side of the bucket wheel assembly, said second set of nozzles extending transversely of the bucket wheel assembly in a second direction inclined to the direction of movement of the bucket members and forming a v-shaped configuration with the first set of nozzles.

Such an arrangement is especially useful when the bucket wheel assembly is moved transversely to and fro during operation, with the first set of nozzles being operated when the bucket wheel assembly is moving in one transverse direction with the first set of nozzles leading, and the second set of nozzles being operated when the bucket wheel assembly is moving in the opposite transverse direction with the second set of nozzles leading.

The framework may be mounted on a supporting means for rotation about a substantially horizontal axis relative thereto, with the rotary valve means comprising a first part secured to the supporting means and having the means to enable a source of liquid under pressure to be connected thereto, and second part secured to the framework and rotatable therewith to cause said selective supply of liquid under pressure to each nozzle means in turn.

The bucket wheel assembly may comprise a pair of said series of bucket members mounted in the framework in transversely spaced relationship, with each series of bucket members having a series of the nozzle means and a rotary valve means.

The bucket wheel assembly may also include a slurry reservoir, means for feed water into the reservoir, the reservoir being positioned to receive the slurry of material from each bucket member as the framework rotates to cause each bucket member to discharge the slurry therein, and means for withdrawing slurry from the reservoir.

Figure 2:
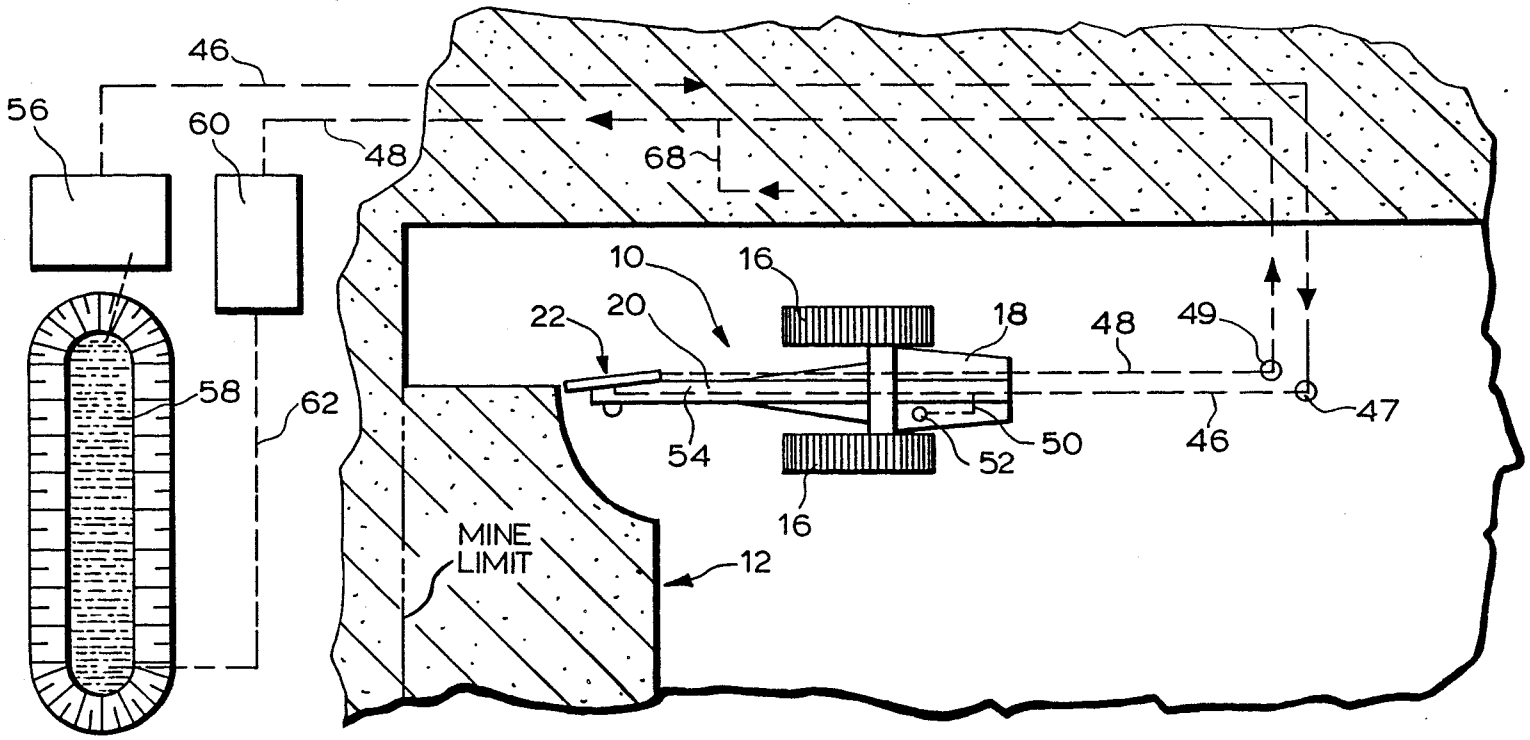
Figure 3:
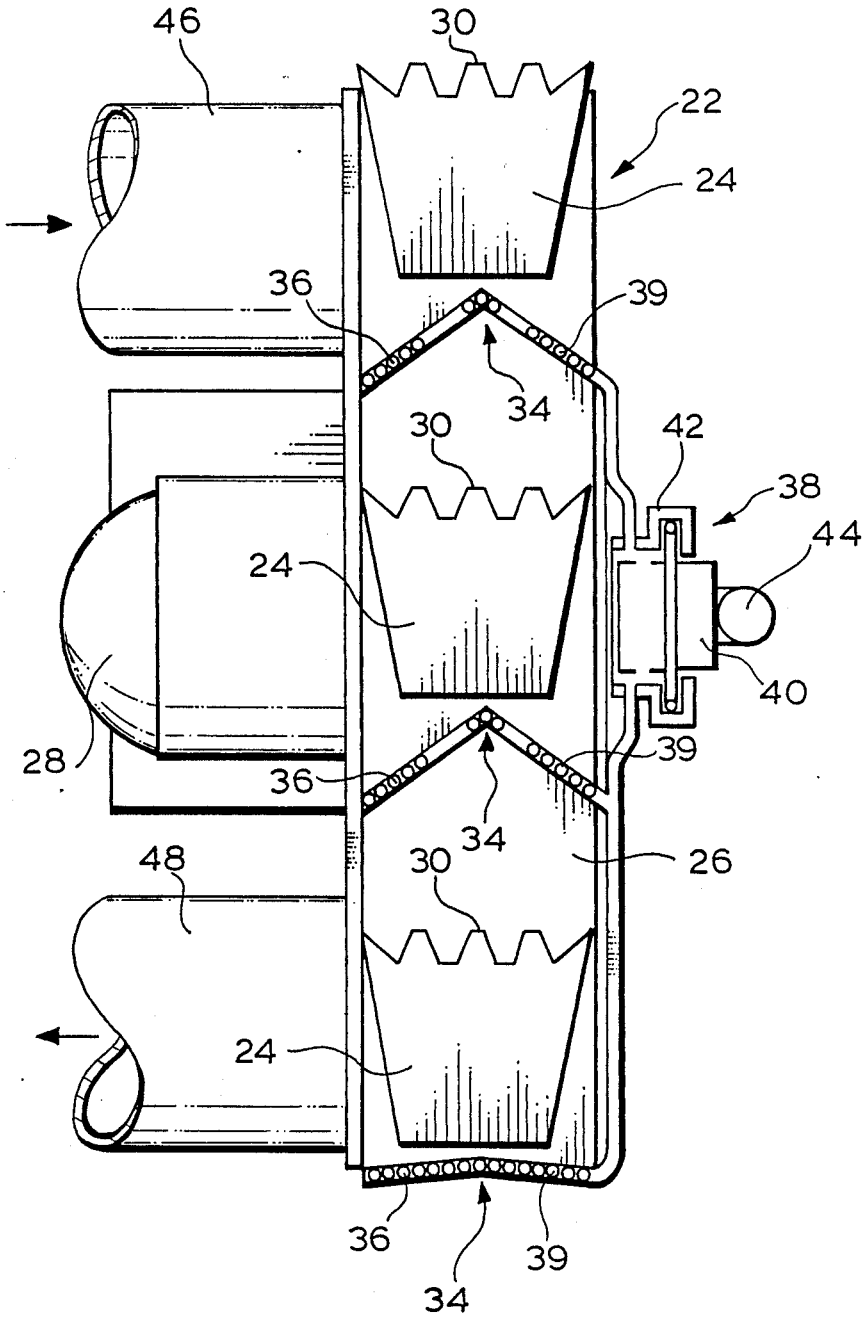
Figure 4:
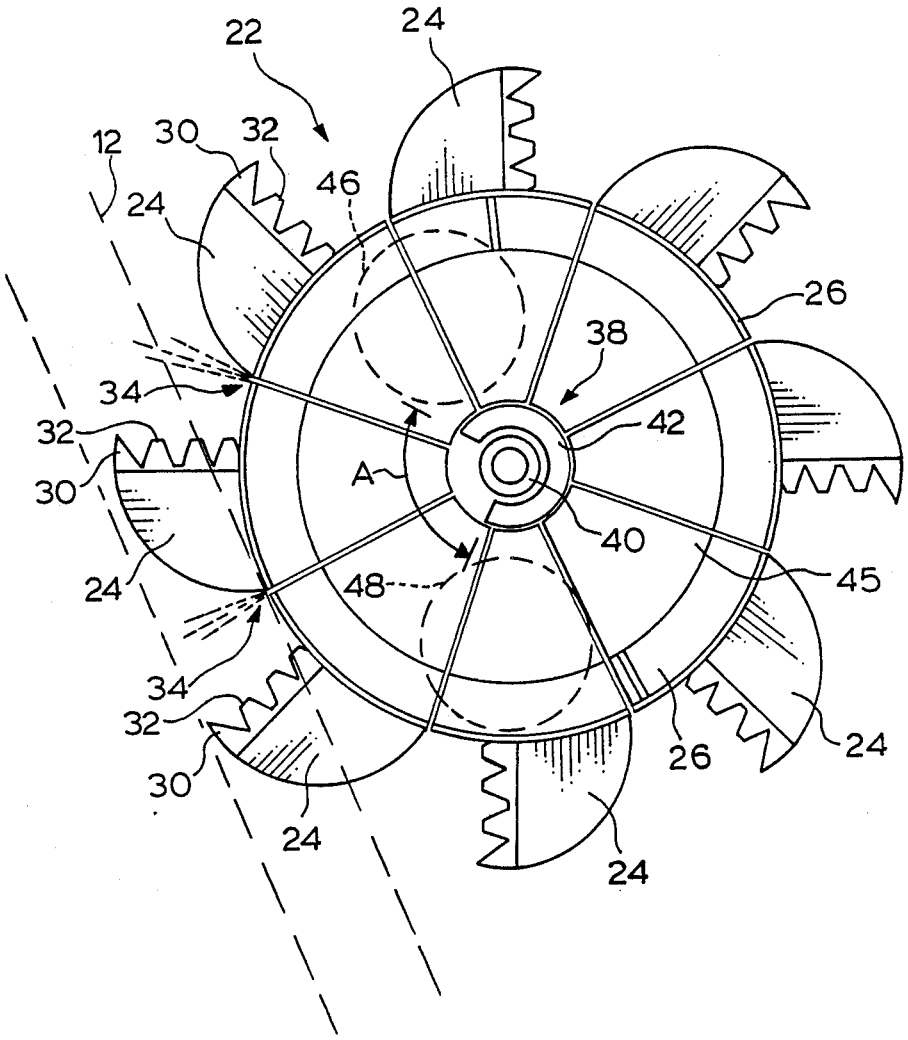
Figure 5:
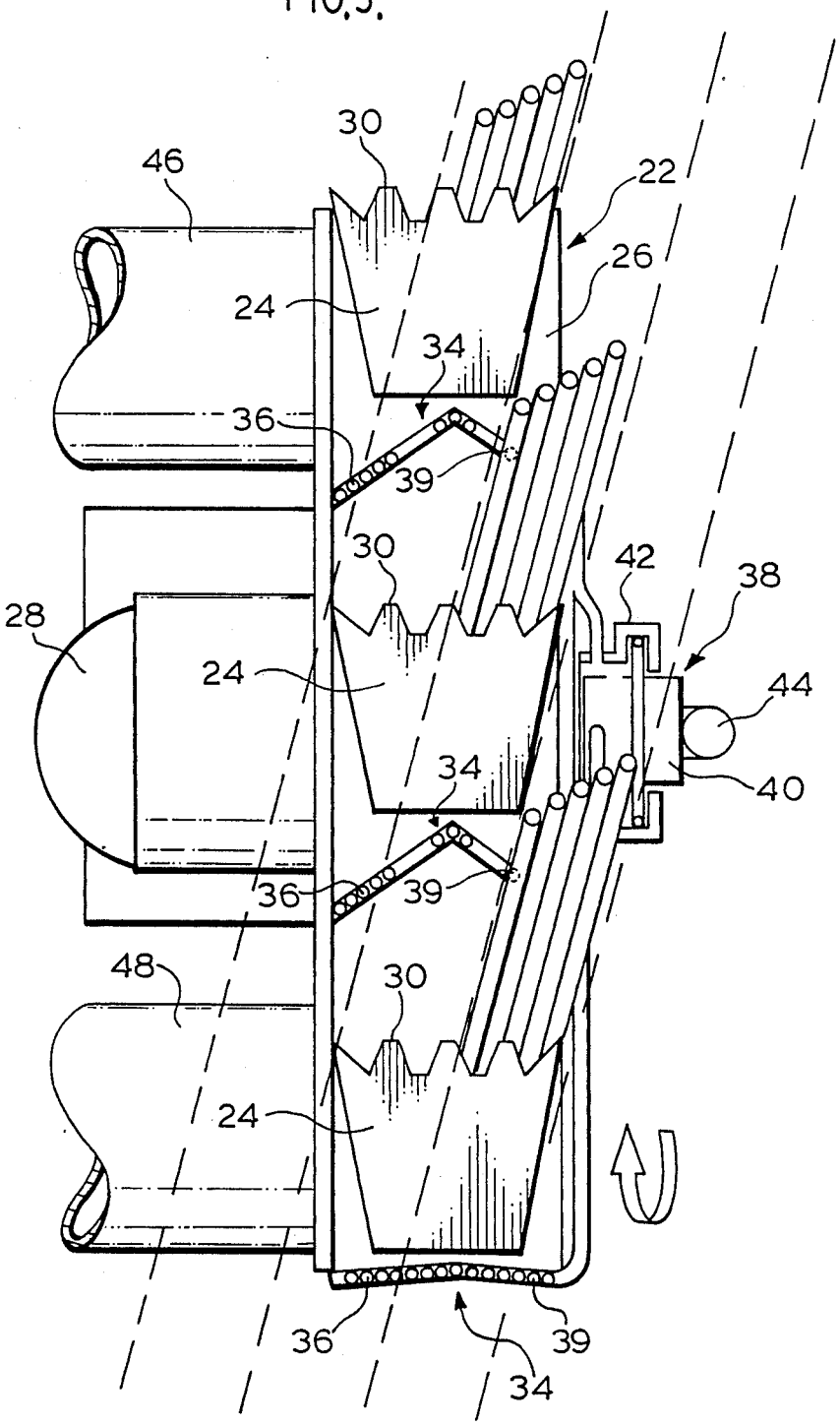
Figure 6:
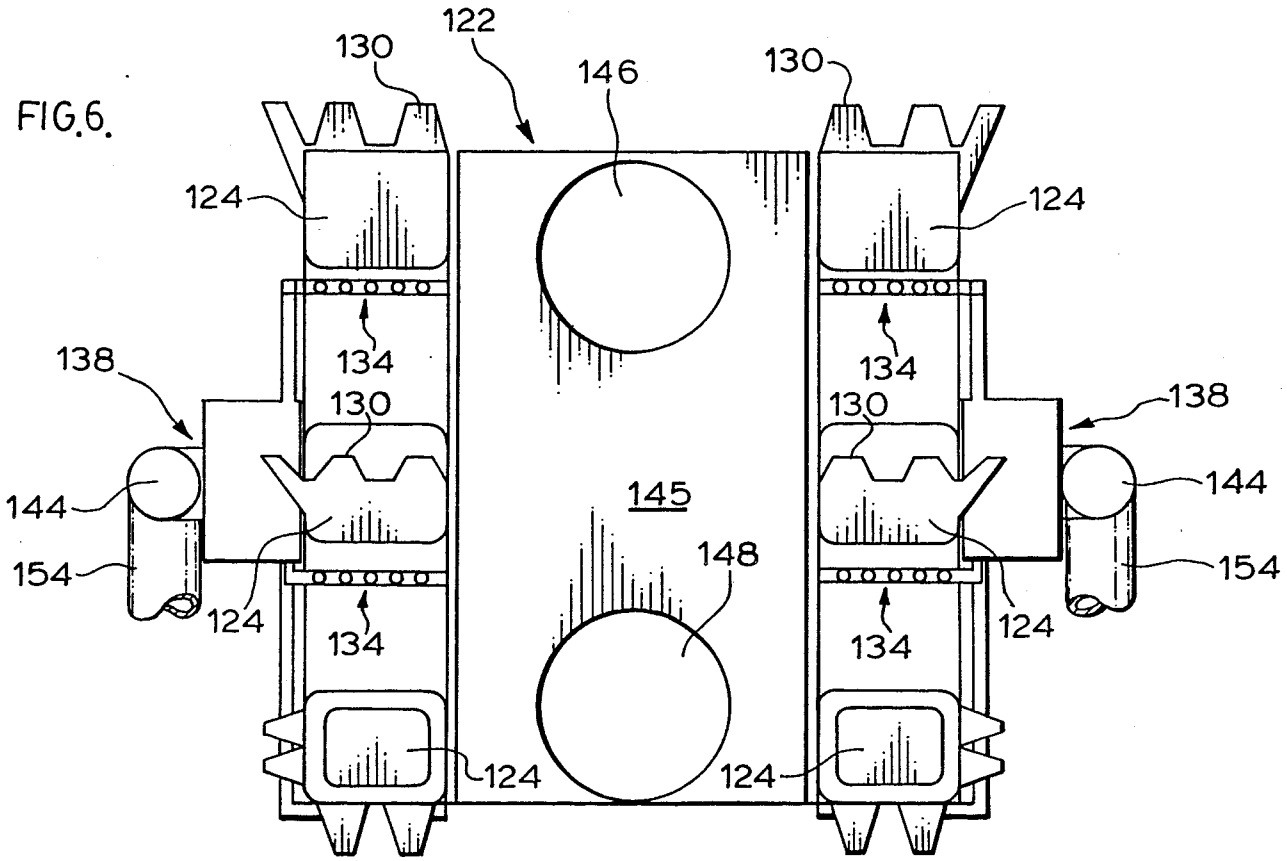

Embodiments of the invention will now be described, by way of example, with reference to the accompanying drawings, of which:

FIG. 1 is a diagrammatic side view of a mining machine incorporating a bucket wheel assembly in accordance with one embodiment of the invention and being used in an oil sand open pit mine, FIG. 2 is a diagrammatic plan view of the mining machine and mine of FIG. 1, FIG. 3 is a diagrammatic front view of the bucket wheel assembly of the mining machine, FIG. 4 is a diagrammatic side view of the bucket wheel assembly of FIG. 3, FIG. 5 is a diagrammatic front view of the bucket wheel assembly indicating the manner in which slices are cut in the oil sand by the water jets, and FIG. 6 is a diagrammatic front view of a bucket wheel assembly in accordance with another embodiment of the invention.

Referring to the drawings, FIGS. 1 and 2 show an area of an open pit oil sand mine with a mining machine 10 operating at the working face 12. The mining machine comprises a self-propelled chassis 14 mounted on endless track 16, a body unit 18 mounted on the chassis 14 and horizontally moveable relative thereto about a vertical axis, a boom 20 mounted adjacent its rear end on the body unit 18 for vertical movement relative thereto about a horizontal axis, and a bucket wheel assembly 22 mounted on the front end of the boom 20 and rotatable relative thereto about a horizontal axis. As so far described, the mining machine 10 is conventional and will not be described further since details of its construction and operation will be readily apparent to a person skilled in the art.

As shown more particularly in FIGS. 3 and 4, the bucket wheel assembly 22 is constructed in accordance with a preferred embodiment of the invention and comprises a series of bucket members 24 secured to a framework 26 mounted on the front end of the boom 20 for relative rotation thereto about a horizontal axis, with a drive motor 28 provided to effect such rotation. The buckets 24 are secured to the framework 26 at spaced positions around the periphery thereof, with each bucket 24 having a toothed leading edge 30 engagable with the ground as the framework 26 rotates The side edges 32 of each bucket 24 are also toothed.

A series of nozzle means 34 are mounted on the framework 26, each nozzle means 34 being located between an adjacent pair of buckets 24 and spaced in the direction of rotary movement of the buckets 24 from the leading edge 30 of a following bucket 24. Each nozzle 34 comprises set of nozzles 36 aligned in a straight row adjacent one side of the bucket assembly 22, the first set of nozzles 36 extending transversely of the bucket wheel assembly 22 in a first direction inclined to the direction of movement of the buckets 24. Each nozzle means 34 also comprises a second set of nozzles 39 aligned in a straight row adjacent the opposite side of the bucket wheel assembly 22, the second set of nozzles 36 extending transversely of the bucket wheel assembly 22 in a second direction which is inclined to the direction of movement of the bucket 24 and forms a v-shaped configuration with the first set of nozzles 36.

The bucket wheel assembly 22 is also provided with a rotary valve 38 which is operated by rotation of the framework 26. The rotary valve 38 comprises a stationary first part 40 secured to the boom 20, and a second part 42 secured to the framework 26 for rotation therewith. The specific construction of the rotary valve 38 is not a feature of the invention, since a person skilled in the art will readily be able to construct a suitable valve from the description of its function which will follow later. The stationary valve part 40 has a high pressure water inlet 44, and the rotary valve part 42 is designed to cause water under pressure therefrom to be supplied to the nozzles 34 only over a 90° angular range, indicated as angle A in FIG. 4, when the nozzles 34 are directed towards the mine working face.

Clean water is supplied to a slurry reservoir 45 in the bucket wheel assembly 22 through an intake pipe 46, and the slurry produced during operation (as will be described in more detail later) leaves the slurry reservoir 45 through an outflow pipe 48. As indicated in FIG. 2, a branch line 50 from the intake pipe 46 supplies water to the inlet of a high pressure pump 52 carried by the body unit 18, with the high pressure pump outlet being connected by high pressure line 54 to the inlet 44 of the stationary part 40 of the rotary valve 38. Clean water supplied through intake pipe 46 is obtained from a clean water pond 56, which is formed by overflow from a tailings pond 58. Output slurry is pumped by a suction pump (not shown) located adjacent the slurry reservoir 45 along outflow pipe 48 to a surge pit 60, where the slurry is subjected to treatment which will be described later, and water therefrom is passed to tailings pond 58 via pipe 62. Intake and outflow pipes 46, 48 include booster pumps 47, 49 respectively.

In a mining operation, the mining machine 10 is operated in the general manner indicated in FIGS. 1 and 2 to mine oilsand from the working face 12. As shown, the bucket wheel assembly 22 positioned at the beginning of a left to right arcuate portion during which the body unit 10 will be swung about a vertical axis relative to the chassis 14 to effect such arcuate motion. The bucket wheel assembly 22 is rotated in a through the inlet pipe 46 to the slurry reservoir 45, and high pressure water is supplied through rotary valve 38 to nozzles 39 only, i.e. not nozzles 36, by appropriate adjustment of a suitable valve (not shown) As explained earlier, rotary valve 38 operates in such a manner that high pressure water is only emitted from the nozzles 39 while they are directed towards the working face 12, i.e. while they are passing through angular range A.

Referring now more particularly to FIGS. 4 and 5, and bearing in mind that the bucket wheel assembly 22 is swinging to the right in FIG. 5, high pressure water jets from each set of nozzles 39 cut slices of oilsand which are collected in the following bucket 24. For example, bucket the third shown at the bottom of the bucket wheel assembly 22 collects slice the third which has been cut by the immediately preceding nozzles 39. Similarly, bucket the second shown mid-way through its movement through angular range A collects slice 2 cut by the immediately preceding nozzles 39 and bucket the first shown at the top of the bucket wheel assembly 22 is in the last stages of collecting the first slice cut by its immediately preceding nozzles 39 (not shown in FIG. 5).

As is evident from FIG. 4, the oilsand slurry in each bucket 24 is flowed out of the bucket as it reaches the top of the bucket wheel assembly 22 and falls into the slurry reservoir 45. Oilsand slurry in the reservoir 45 is then pumped by a suction pump 55 (FIG. 1) and booster pump 49 along the outflow pipe 60 to the surge pit 48. Appropriate chemicals and air are passed into outflow pipe 48 through line 68 so that the surge pit 60 acts as a flotation cell where the bitumen floats on the water. Bitumen froth is subsequently extracted, and silty water and sand are passed through pipe 62 to the tailings pond 58. The bitumen froth is then subjected to an appropriate bitumen extraction process. As previously indicated, clean water from the tailings pond 58 is recycled back to the bucket wheel assembly 22. The size of the nozzles 34 and the water pressure required to cut the oilsand slices can readily be determined with routine trial and experiment by a person skilled in the art.

FIG. 6 shows a diagrammatic view of another embodiment of bucket wheel assembly 122 which has left and right hand series of buckets 124 rotatably mounted on opposite sides of a axis. Each series of buckets 124 is provided with a rotary valve 138 with high pressure supply pipe 124 similar to the rotary valve 38 and high pressure pipe 54 of the previous embodiment. In this case, each set of nozzles 134 comprises a straight row of nozzles extending parallel to the axis of rotation of the bucket wheel and is located intermediate each adjacent pair of buckets 124. Thus, one series of buckets 124 and associated nozzles 134 are operated when the bucket wheel member 122 is swinging in one direction, and the other series of buckets 124 and respective nozzles 134 are operated when the bucket wheel assembly 122 is swinging in the opposite direction, the leading series relative to the direction of travel of the boom 20 being the series operated. Each series of buckets 124 feeds the oilsand slices into the slurry reservoir 145 to which clean water is supplied through supply pipe 146, the oilsand slurry being withdrawn from the reservoir 145 through outflow pipe 148.

The advantages of the invention will be readily apparent to a person skilled in the art from the foregoing description of preferred embodiments. The high pressure water jets from the nozzles effects all or most of the cutting of the oilsand slices, with the result that the leading edges of the buckets are not required to effect any substantial amount of oilsand cutting. The buckets and in fact the bucket wheel assembly can therefore be less robust and hence less costly than would otherwise be the case. The water jets also effect some cooling of the leading edges of the buckets, thereby reducing wear thereof. This is especially advantageous in the winter when oilsands freeze up and thus become much harder. Additionally, the water jets effect some initial separation of the bitumen from the sand, thereby lowering costs in a subsequent bitumen extraction process. The fact that the product is an oilsand slurry is particularly advantageous for presently proposed cold water bitumen extraction processes.

Although the invention is especially useful in connection with the mining of oilsands, it is also useful for mining other unconsolidated material such as coal, phosphate, uranium, gold, etc.

Other embodiments, advantages and uses of the invention will also be apparent to a person skilled in the art, the scope of the invention being defined in the appended claims.

I claim:

1. A bucket wheel assembly for excavating solid material from the ground which can be slurried with water, said apparatus comprising:

a series of bucket members mounted on a framework rotatable about a substantially horizontal axis, said bucket members being secured to the framework at spaced positions around the periphery thereof, each bucket member having a leading edge portion engagable with the ground as the framework rotates to cause material to be scooped from the ground into a bucket member, a series of nozzle means mounted around the framework, each nozzle means comprising a set of nozzles aligned in a substantially straight row which extends transversely of the bucket wheel assembly in a direction substantially parallel to the axis of rotation of the framework and being located between an adjacent pair of bucket members and spaced in the direction of movement of the bucket members from the leading edge portion of a following bucket member, and rotary valve means connected to the series of nozzle means and having means to enable a source of liquid under pressure to be connected thereto, said rotary valve means being operated by rotation of the framework, when a source of liquid under pressure is connected to said rotary valve means, to cause liquid under pressure to be selectively supplied from said source of liquid under pressure to each nozzle means in turn when such nozzle means and its following bucket member are approaching the ground to cause liquid from such nozzle means to impinge on the ground and form a slurry of the said material which is subsequently scooped into a following bucket member.

2. A bucket wheel assembly according to claim 1 wherein each said nozzle means is inclined to the direction of movement of the bucket members.

3. A bucket wheel assembly according to claim 1 also including a slurry reservoir, means for feeding water into said reservoir, said reservoir being positioned to receive said slurry of material from each bucket member as the framework rotates to cause each bracket member to discharge the slurry therein, and means for withdrawing slurry from said reservoir.

4. A bucket wheel assembly for excavating solid material from the ground which can be slurried with water, said apparatus comprising:

a series of bucket members mounted on a framework rotatable about a substantially horizontal axis, said bucket members being secured to the framework at spaced positions around the periphery thereof, each bucket member having a leading edge portion engagable with the ground as the framework rotates to cause material to be scooped from the ground into the bucket member, a series of nozzle means mounted around the framework, each nozzle means comprising a first set of nozzles aligned in a substantially straight row adjacent to one side of the bucket wheel assembly, said first set of nozzles extending transversely of the bucket wheel in a first direction inclined to the direction of movement of the bucket members, and a second set of nozzles inclined in a substantially straight row adjacent an opposite side of the bucket wheel assembly, said second set of nozzles extending transversely of the bucket wheel assembly in a second direction inclined to the direction of movement of the bucket members and forming a V-shaped configuration with the first set of nozzles, and being located between an adjacent pair of bucket members and spaced in the direction of movement of the bucket members from the leading edge portion of a following bucket member, and rotary valve means connected to the series of nozzle means and having means to enable a source of liquid under pressure to be connected thereto, said rotary valve means being operated by rotation of the framework, when a source of liquid under pressure is connected to said rotary valve means, to cause liquid under pressure to be selectively supplied from said source of liquid under pressure to each nozzle means in turn when such nozzle means and its following bucket member are approaching the ground to cause liquid from such nozzle means to impinge on the ground and form a slurry of the said material which is subsequently scooped into a following bucket member.

5. A bucket wheel assembly according to claim 4 also including a slurry reservoir, means for feeding water into said reservoir, said reservoir being positioned to receive said slurry of material from each bucket member as the framework rotates to cause each bracket member to discharge the slurry therein, and means for withdrawing slurry from said reservoir.

* * * * *